US005829897A

United States Patent [19]

Murai

[11] Patent Number: 5,829,897

[45] Date of Patent: Nov. 3, 1998

[54] PRINTER AND PRINTING METHOD HAVING CUTTER CONTROL

[75] Inventor: Yasushi Murai, Fussa, Japan

[73] Assignee: Casio Computer Co., Ltd., Tokyo, Japan

[21] Appl. No.: 723,091

[22] Filed: Sep. 30, 1996

[30] Foreign Application Priority Data

Oct. 4, 1995 [JP] Japan ..... 7-257770

[51] Int. Cl.[6] ..... B41J 11/42

[52] U.S. Cl. ..... 400/615.2; 400/582; 400/621; 400/593

[58] Field of Search ..... 400/120.02, 120.18, 400/586, 615.2, 582, 621, 621.1, 593

[56] References Cited

U.S. PATENT DOCUMENTS 5,295,753 3/1994 Godo et al. ..... 400/615.2
5,358,351 10/1994 Murata et al. ..... 400/586
5,447,383 9/1995 Hirono et al. ..... 400/615.2
5,478,157 12/1995 Kohno et al. ..... 400/120.18

*Primary Examiner*—John S. Hilten
*Attorney, Agent, or Firm*—Frishauf, Holtz, Goodman, Langer & Chick

[57] ABSTRACT

Printing on a tape is carried out using an ink ribbon having yellow, magenta, cyan and overprinting ink arranged thereon. First, the ink position of the ink ribbon is aligned with the print position of the tape, and one ink is transferred on the tape. This transfer is repeated for the yellow, magenta and cyan colors at the same print position to accomplish color printing. When color printing is completed, the position of the overprinting ink is aligned with the position of the tape, and the overprinting ink is overprinted on the color-printed area line by line. When the cut position of the tape reaches the position of a cutter, printing with the overprinting ink and feeding of the tape stop. In this state, the tape is cut. Then, the tape is cut when printing with the overprinting ink is carried out to the trailing edge of the color-printed area.

40 Claims, 4 Drawing Sheets

PRINTER AND PRINTING METHOD HAVING CUTTER CONTROL

BACKGROUND OF THE INVENTION

1. Field of the Invention

The present invention relates to a printer and a printing method, and, more particularly, to a printer which thermally transfers ink onto an elongated recording medium.

2. Description of the Related Art

There are tape printers known as apparatuses for preparing labels, such as index labels for audio tapes or the like or name labels for personal goods.

An ordinary tape printer prints characters input through a keyboard or an image, scanned by an image reader, by heating up its thermal print head to thermally transfer ink coated on an ink ribbon onto a tape. Every time one line of printing is performed, the tape is sequentially fed out and is discharged out of the tape printer through a tape discharge port. The tape printer cuts the tape in the desired position by activating a cutter provided at the tape discharge port.

There is a given distance between the thermal print head and the cutter, so that during printing and tape feeding, the tape cutting position may become where the cutter is positioned. In this case, the tape printer should temporarily stop printing and tape feeding in order to cut the tape at the desired position.

The thermal print head however discharges heat while printing is stopped to cut the tape. Therefore, the temperature of the thermal print head after the tape is cut becomes immediately lower than the temperature before the cutting of the tape. The amount of ink to be transferred onto a tape is affected by the temperature of the thermal print head.

The conventional tape printer therefore suffers an uneven print density as a tape is cut.

There is a color tape printer which has an ink ribbon holding ink of yellow (Y), magenta (M) and cyan (C) and can print a color image by overprinting the Y, M and C inks. In order to cut the tape at the desired position, this color tape printer should temporarily stop printing and tape feeding while printing with one of the color inks is in progress. Naturally, an uneven print density occurs on what is printed with one of the yellow, magenta and cyan inks. That is, the color tape printer also inevitably suffers from the occurrence of an uneven print density.

SUMMARY OF THE INVENTION

Accordingly, it is an object of the present invention to provide a printer which can avoid the occurrence of an uneven print density.

To achieve the above object, a printer according to one aspect of this invention comprises:

an ink ribbon retaining ink;

print means for printing on a recording medium with the ink of the ink ribbon;

first feed means for feeding the ink ribbon;

second feed means for feeding the recording medium;

cut means for cutting the recording medium; and control means for controlling operations of the print means, the first and second feed means and the cut means, the control means including print control means for causing the print means to transfer the ink on the recording medium while causing the first and second feed means to simultaneously feed the ink ribbon and the recording medium, and cut control means for causing the second feed means to feed the recording medium until the cut position of the leading edge portion of the recording medium comes to the position of the cut means while stopping the operation of the print means in response to termination of an operation controlled by the print control means.

It is preferable that the print means transfer the ink on the recording medium by a thermal transfer method, particularly, by a sublimination type thermal transfer method.

In this printer, the print control means causes the first and second feed means to continuously feed the ink ribbon and the recording medium until the print means finishes printing over a predetermined range of the recording medium.

Further, the second feed means may operate in responsive to the operation of the first feed means.

With this structure, the printer does not interrupt printing and the feeding of the recording medium even when the cut position of the leading edge portion of the recording medium reaches the position of the cut means during printing. After the entire printing is completed, the cut position of the leading edge portion of the recording medium is moved again to the position of the cut means. Therefore, the print means does not discharge heat during printing and can thus avoid a variation in its temperature, thus preventing an uneven ink density from occurring.

In this printer, the recording medium may have position marks; and the printer may further comprise:

detection means for detecting the position marks; and position discrimination means for discriminating the position of the recording medium from the position marks detected by the detection means.

In this case, for example, said position marks may be provided at equal intervals along the feeding direction of the recording medium; and the position discrimination means may have counter means for counting the number of the position marks.

The cut control means may include:

discrimination means for discriminating if the cut position of the leading edge portion of the recording medium comes to the position of the cut means; and means for activating the cut means when the discrimination means discriminates that the cut position of the leading edge portion of the recording medium has come to the position of the cut means.

The cut control means may include:

discrimination means for discriminating if the cut position of the leading edge portion of the recording medium comes to the position of the cut means; and means for discriminating if the cut means is activated, whereby when the discrimination means discriminates that the cut position of the leading edge portion of the recording medium has come to the position of the cut means, the operation of the second feed means is stopped until the activation of the cut means is discriminated.

To achieve the aforementioned object, a printer according to the second aspect of this invention comprises:

an ink ribbon having regularly arranged ink areas retaining ink for printing an image and predetermined areas not retaining color ink;

print means for transferring the ink of the ink areas of the ink ribbon on a recording medium;

first feed means for feeding the ink ribbon;

second feed means for feeding the recording medium;

cut means for cutting the recording medium; and control means for controlling operations of the print means, the first and second feed means and the cut means, the control means including print control means for causing the print means to transfer the ink of the ink areas on the recording medium while causing the first and second feed means to simultaneously feed the ink ribbon and the recording medium, and cut control means for causing the second feed means to simultaneously feed the ink ribbon and the recording medium with the predetermined areas placing over the recording medium until the cut position of the leading edge portion of the recording medium comes to the position of the cut means, in response to termination of an operation controlled by the print control means.

In this printer, the color ink means colored ink including black, gray and white ink.

It is preferable that the print means transfer the ink on the recording medium by a thermal transfer method, particularly, by a sublimination type thermal transfer method.

In this printer, the print control means causes the first and second feed means to continuously feed the ink ribbon and the recording medium until the print means finishes printing over a predetermined range of the recording medium with the ink.

Further, the second feed means may operate in responsive to the operation of the first feed means.

With this structure, the printer does not interrupt printing and the feeding of the recording medium even when the cut position of the leading edge portion of the recording medium, which is to be cut, reaches the position of the cut means while printing with the ink in the ink areas is in progress. After the entire printing is completed, the cut position of the leading edge portion of the recording medium, which is to be cut, is moved again to the position of the cut means. Therefore, the print means does not discharge heat during printing and can thus avoid a variation in its temperature, thus preventing an uneven ink density from occurring.

In this printer, the recording medium may have position marks; and the printer may further comprise:

detection means for detecting the position marks; and position discrimination means for discriminating the position of the recording medium from the position marks detected by the detection means.

In this case, for example, said position marks may be provided at equal intervals along the feeding direction of the recording medium; and the position discrimination means may have counter means for counting a number of the position marks.

The cut control means may include:

discrimination means for discriminating if the cut position of the leading edge portion of the recording medium comes to a position of the cut means; and means for activating the cut means when the discrimination means discriminates that the cut position of the leading edge portion of the recording medium has come to the position of the cut means.

The cut control means may include:

discrimination means for discriminating if the cut position of the leading edge portion of the recording medium comes to a position of the cut means; and means for discriminating if the cut means is activated, whereby when the discrimination means discriminates that the cut position of the leading edge portion of the recording medium has come to the position of the cut means, an operation of the second feed means is stopped until an activation of the cut means is discriminated.

In the printer according to this second aspect of this invention, the predetermined areas may be protection layer areas retaining a protective agent for forming a protection layer for protecting a print surface of the recording medium printed with the ink; and the print means may transfer the protective agent on the recording medium which is printed with the ink of the ink areas when the ink ribbon is fed with the protection layer areas placed over the recording medium.

Each of the ink areas can retain a plurality colors of ink arranged regularly, thus ensuring color printing.

To achieve the aforementioned object, according to the third aspect of this invention, there is provided a printing method for a printer provided with a cutter for printing an image while feeding a recording medium and cutting the leading edge portion of the recording medium at a desired position with the cutter, which method comprises the steps of:

printing an image on the recording medium without interrupting feeding of the recording medium even when the desired position of the recording medium reaches the position of the cutter until printing an image on a predetermined area of the recording medium is completed;

feeding the recording medium until the desired position of the recording medium comes to the position of the cutter after printing an image on the predetermined area of the recording medium is completed; and cutting the recording medium with the cutter when feeding of the recording medium is stopped.

It is preferable that the printer prints an image by a thermal transfer method, particularly, by a sublimination type thermal transfer method.

An ink cassette according to the fourth aspect of this invention comprises:

a ribbon feed reel on which an ink ribbon having regularly arranged ink areas each retaining ink for printing an image by a thermal transfer method and predetermined areas not retaining color ink is wound around, for feeding the ink ribbon;

a ribbon rewind reel for rewinding the ink ribbon;

a recording medium feed reel having an elongated recording medium wound around, for feeding the recording medium; and a cassette case for accommodating the ribbon feed reel, the ribbon rewind reel and the recording medium feed reel.

DETAILED DESCRIPTION OF THE PREFERRED EMBODIMENT

A preferred embodiment of the present invention will now be described with reference to the accompanying drawings.

Figure 1:
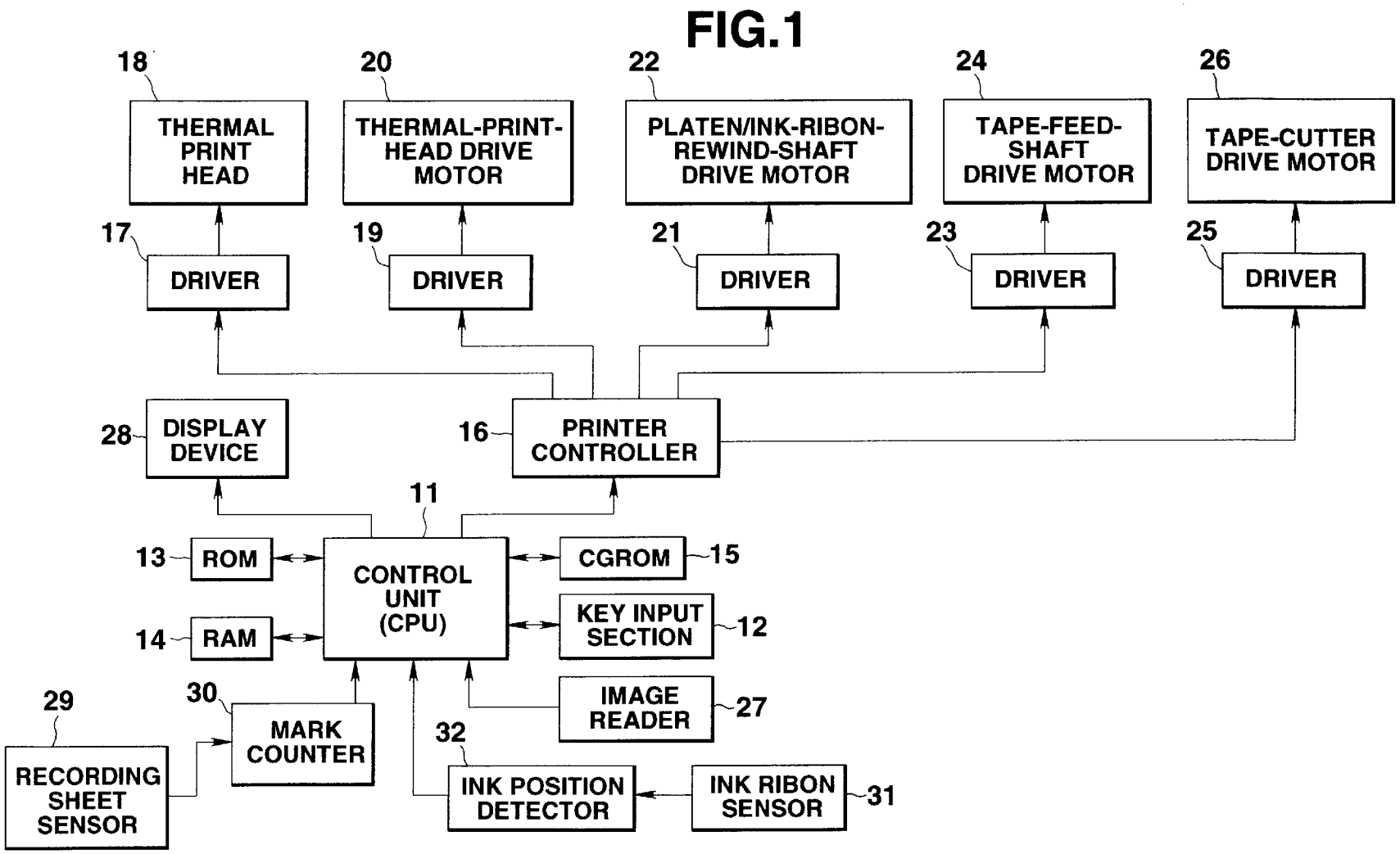
FIG. 1 is a block diagram illustrating the structure of an electronic circuit of a color tape printer according to one embodiment of this invention.

FIG. 1 presents a block diagram illustrating the structure of an electronic circuit of a sublimination-oriented thermal transfer type color tape printer according to one embodiment of this invention.

The electronic circuit of this color tape printer has a control unit 11 constituted of a CPU (Central Processing Unit).

When the color tape printer is powered on, the control unit 11 invokes a system program which has previously been stored in a ROM (Read Only Memory) 13. The control unit 11 controls the operation of the color tape printer in accordance with the system program.

Connected to this control unit 11 are a key input section 12, the ROM 13, a RAM (Random Access Memory) 14, a CGROM (Character Generator ROM) 15, a printer controller 16, an image reader 27, a display device 28, a mark counter 30 and an ink position detector 32.

The key input section 12 has character input keys, an execution key, a print key, and function keys. The character input keys include character keys, numeral keys and symbol keys. A string of characters which is text data is input using the character input keys. The settlement of various kinds of input data, the settlement of selection data and the initiation of any set function are instructed by the depression of the execution key. The setting of the lengths of the leading margin and the trailing margin, which will be discussed later, is accomplished by operating one of the function keys and numeral keys.

Stored previously in the ROM 13 the system program which is executed by the control unit 11 and which includes a program for controlling the entry of text data and image data, a program for controlling the printing operation, and a program for controlling the feeding of a tape and an ink ribbon.

The RAM 14 includes an input buffer, an image memory and a print buffer. The input buffer stores text data input through the key input section 12. The image memory stores image data input from the image reader 27. The dot pattern of text data is developed in the print buffer based on the image data stored in the image memory or data from the CGROM 15.

The RAM 14 also serves as a work area for the control unit 11. For example, data on the lengths of the leading margin and the trailing margin, which will be discussed later, and the position of a tape are temporarily stored in this work area.

The CGROM 15 has previously stored pattern data corresponding to all the character codes, numeral codes and symbol codes which can be entered using the key input section 12.

Connected to the printer controller 16 are a head driver 17 for energizing and heating the thermal print head 18, a head-drive-motor driver 19 for driving a thermal-print-head drive motor 20, a rewind-shaft-drive-motor driver 21 for driving a platen/ink-ribbon-rewind-shaft drive motor 22, a feed-shaft-drive-motor driver 23 for driving a tape-feed-shaft drive motor 24, and a cutter-drive-motor driver 25 for driving a tape-cutter drive motor 26. The control unit 11 controls the individual drivers 17, 19, 21, 23 and 25 through the printer controller 16. Accordingly, the operations of the thermal print head 18, the thermal-print-head drive motor 20, the platen/ink-ribbon-rewind-shaft drive motor 22, the tape-feed-shaft drive motor 24 and the tape-cutter drive motor 26 are controlled.

The image reader 27 acquires an image, scanned by a scanner, as image data. The display device 28 displays characters and/or symbols entered through the key input section 12 or displays an image to be printed based on a dot pattern developed in the print buffer.

A recording sheet sensor 29 is connected to the mark counter 30. The recording sheet sensor 29 is of a reflection type photosensor which detects each position mark on a tape and outputs a position detection signal. The mark counter 30 is comprised of a counter which counts up the count every time the position detection signal is input. The count of the mark counter 30 is cleared when the tape changes its feeding direction. The number of the position detection signals counted by the mark counter 30 is input to the control unit 11 as tape position data and is stored as such in the RAM 14. The position marks are put on a breakaway sheet at the back of the tape along the feeding direction of the tape (the direction in which the tape is fed at the time of printing, i.e., the direction toward outside of the color tape printer from inside).

An ink ribbon sensor 31 is connected to the ink position detector 32. The ink ribbon sensor 31 optically detects boundary marks put on the ink ribbon and outputs an ink position detection signal. The ink position detection signal output from the ink ribbon sensor 31 is input to the ink position detector 32. The ink position detector 32 detects the position of each ink on the ink ribbon in accordance with the ink position detection signal. An ink position signal output from the ink position detector 32 is input to the control unit 11. The boundary marks are provided at the boundaries at the areas of the yellow ink, the magenta ink, the cyan ink and the overprinting ink.

According to this color tape printer, margins of arbitrary lengths, which are called "leading margin" and "trailing margin" throughout the description of this embodiment, are provided on the front and back of an area where an image is to be printed. To set the margins, a user should operate one of the function keys on the key input section 12 to set a margin setting mode. In this mode, the display device 28 displays a message "length of leading margin?." Then, the user enters the desired length using the numeral keys and instructs the settlement of the entered length by using the execution key. As a result, the length of the leading margin is set. The length of the trailing margin is likewise set. When the lengths of the leading margin and trailing margin are set, the control unit 11 computes the number of position marks which can be fitted within the lengths of the leading margin and the trailing margin. The computation may be accomplished by multiplying the entered lengths by a predetermined coefficient. The computed number of position marks fittable within the lengths of the leading margin and the trailing margin is stored in the RAM 14. In this tape printer, the lengths of the leading margin and the trailing margin, if not set by the user, are automatically set to "0."

Figure 2:
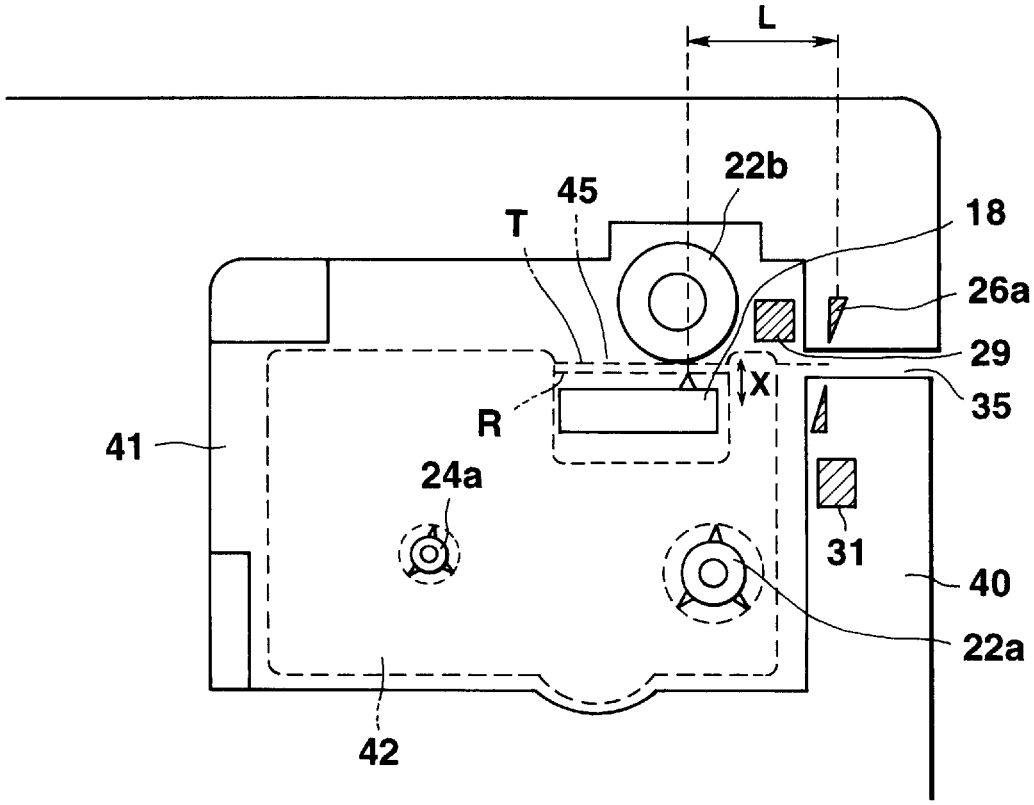
FIG. 2 is a diagram showing the structure of a cassette retainer provided in the main body of the color tape printer according to this embodiment.

FIG. 2 is a diagram showing the structure of a cassette retainer 41 provided in the main body 40 of the color tape printer.

Referring to FIG. 2, the cassette retainer 41 comprises the thermal print head 18, a platen roller 22*b* provided to face the thermal print head 18, an ink ribbon rewind shaft 22*a* for feeding the ink ribbon, a tape feed shaft 24*a* for feeding the tape, the recording sheet sensor 29 for detecting a tape position, the ink ribbon sensor 31 for detecting the position of the color ink ribbon, a tape discharge portion 35 for discharging the tape out of the tape printer, and a cutter 26*a* provided at the tape discharge portion 35 to cut the tape at a predetermined position.

As the drive mechanism (not shown) of the thermal-print-head drive motor 20 is driven, this head 18 is moved in the direction indicated by an arrow X in FIG. 2. As the control unit 11 controls the head-drive-motor driver 19 through the printer controller 16, the thermal print head 18 is pressed against the platen roller 22*b* or is separated therefrom as needed. The heating element (not shown) of the thermal print head 18, when heated, sublimates the ink on the ink ribbon and transfers it on the tape. This thermal print head 18 is controlled by the control unit 11 through the printer controller 16 and the head driver 17.

As the transmission mechanism (not shown) of the platen/ink-ribbon-rewind-shaft drive motor 22 is driven, the ink ribbon rewind shaft 22*a* and the platen roller 22*b* are rotated in the feeding direction of the ink ribbon and tape. As the transmission mechanism (not shown) of the tape-feed-shaft drive motor 24 is driven, the tape feed shaft 24*a* rotates in the opposite direction to the feeding direction of the tape.

As the drive mechanism (not shown) of the tape-cutter drive motor 26 is driven, the cutter 26*a* is actuated to cut the tape. As shown in FIG. 2, "L" denotes the distance between the ink transfer position of the thermal print head 18 and the position of the cutter 26*a*.

Figure 3:
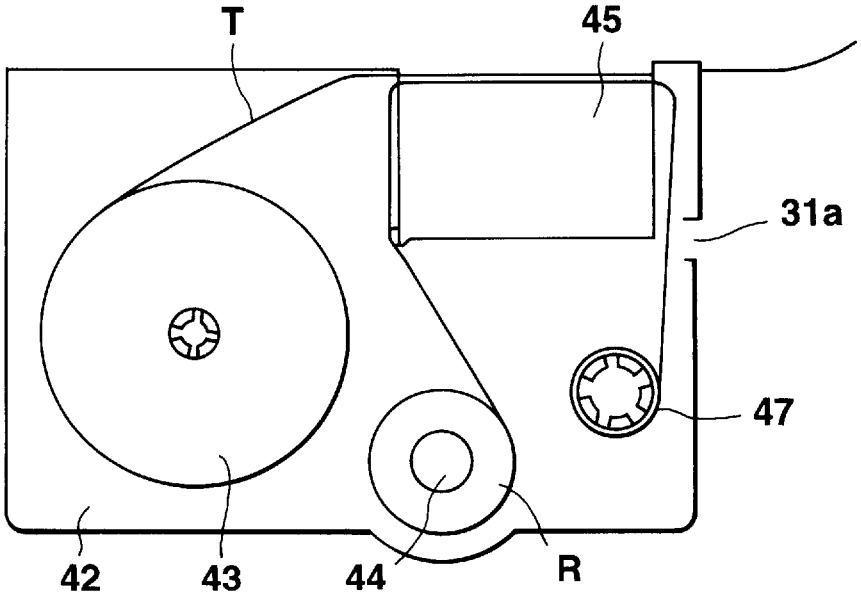
FIG. 3 is a diagram depicting the internal structure of an ink tape cassette which is to be loaded into the cassette retainer of the color tape printer according to this embodiment.

FIG. 3 shows the structure of an ink tape cassette 42 which is to be loaded into the cassette retainer 41.

Referring to FIG. 3, the ink tape cassette 42 has a head retainer 45 and a window 31*a*. The ink tape cassette 42 accommodates a tape feed reel 43, an ink ribbon feed reel 44, and an ink ribbon rewind reel 47. The tape feed reel 43, the ink ribbon feed reel 44 and the ink ribbon rewind reel 47 are designed to be rotatable.

A tape T is wound around the tape feed reel 43. An ink ribbon R is wound around the ink ribbon reel 44. The tape feed reel 43 is fitted on the tape feed shaft 24*a*, and the ink ribbon rewind reel 47 is fitted on the ink ribbon rewind shaft 22*a*.

The head retainer 45 is formed by cutting away a part of the main body of the cassette 42, and the thermal print head 18 is to be placed there. The tape T and ink ribbon R pass through the head retainer 45 while overlapping each other in such a way that the ink ribbon R faces the thermal print head 18.

The ink ribbon sensor 31 optically detects the boundary marks on the ink ribbon R through the window 31*a*.

Figure 4:
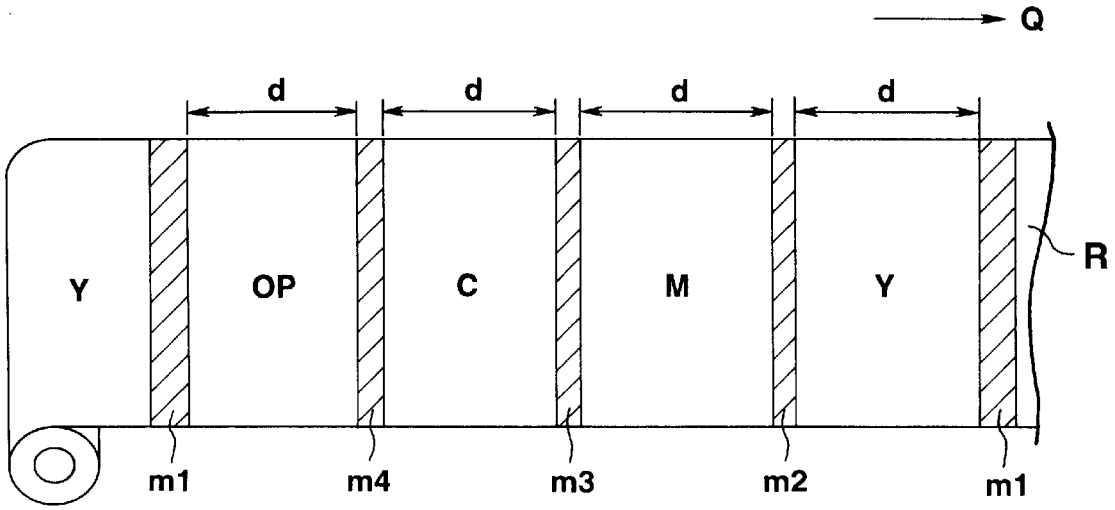
FIG. 4 is a diagram showing the structure of a color ink ribbon to be installed in the ink tape cassette of the color tape printer according to this embodiment.

The ink ribbon R has the yellow ink Y, magenta ink M, cyan ink C and overprinting ink OP repeatedly arranged along the feeding direction Q as shown in FIG. 4. The heat applied by the thermal print head 18 sublimates each of the yellow ink Y, magenta ink M and cyan ink C to be transferred on the tape T. The overprinting ink OP is made of a transparent thermally meltable resin. The heat generated by the thermal print head 18 melts the overprinting ink OP, thus forming a protection layer which protects the image that is printed with the yellow ink Y, magenta ink M and cyan ink C. Each of the ink Y, M, C and OP has the same lengths as the length of one print range d on the tape T. Boundary marks m1 to m4 are provided at the boundaries between the each of the ink Y, M, C and OP to permit the ink ribbon sensor 31 to detect the positions of the color ink.

A breakaway sheet is adhered to the back of the tape T by an adhesive applied to the back of the tape's recording surface. Position marks which are detected by the recording sheet sensor 29 are put on the back of this separate sheet. The position marks are formed by black lines put at equal distances along the feeding direction of the tape T. The recording sheet sensor 29 outputs a position detection signal when detecting that light is not reflected by such position marks.

The operation of this color tape printer will now be described.

Figure 5:
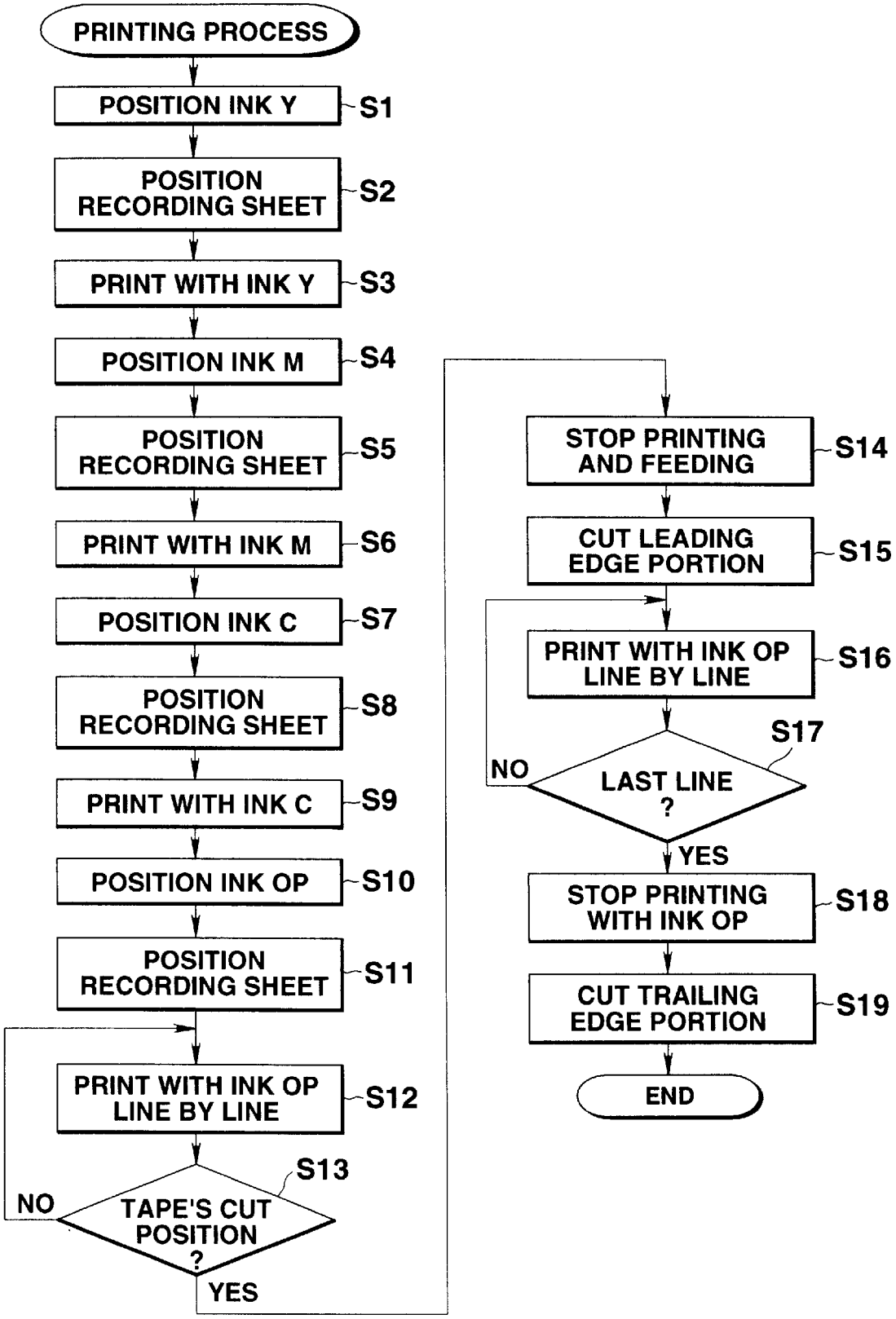
FIG. 5 is a flowchart illustrating a color printing process which is executed by the color tape printer according to this embodiment.

FIG. 5 presents a flowchart illustrating a color printing process which is executed by the color tape printer.

At the time this color tape printer starts printing, the leading edge of the tape T is located at the position of the cutter 26*a* or the position where the tape was cut in the previous printing.

The user might have set the lengths of the leading margin and the trailing margin by using the key input section 12 before printing starts. The control unit 11 should have acquired the number of position marks on the tape T which can be fitted in the lengths of the leading margin and the trailing margin and should have stored the information in the RAM 14. The control unit 11 should also have acquired the number of position marks on the tape T fittable within the length L from the transfer position of the thermal print head 18 to the position of the cutter 26*a*, and should have stored the information in the RAM 14. As the length L is fixed, the number of position marks fittable in the length L may be stored in the ROM.

The process sequence of this flowchart starts when the initiation of printing is instructed by, for example, the operation of the print key on the key input section 12.

When the process sequence starts, the ink ribbon R is fed in the feeding direction Q until the leading position of the yellow ink Y comes to the position corresponding to the transfer position of the thermal print head 18.

The ink ribbon R is fed toward the ink ribbon rewind shaft 22*a*as the ink ribbon rewind shaft 22*a* rotates. The control unit 11 determines the position of the ink ribbon R based on the boundary mark m1 detected by the ink ribbon sensor 31. In this manner, the control unit 11 controls the feeding of the ink ribbon R. At this time, the platen roller 22*b* and the ink ribbon rewind shaft 22*a* rotate with the thermal print head 18 pressed against the platen roller 22*b*. Accordingly, the tape T is fed in the feeding direction by the same distance as the ink ribbon R. At this time, the mark counter 30 is counting the number of the position marks detected by the recording sheet sensor 29. The counted number of the position marks is temporarily stored in the associated register in the RAM 14 as feeding distance information of the tape T (step S1).

Through the process in step S1, the leading edge of the tape T is located outward from the position of the cutter 26*a* by the positioning distance of the target ink of the ink ribbon R. Therefore, the leading edge of the tape T is fed to the initial position or the position of the cutter 26*a* to position the tape T.

With the thermal print head 18 separated from the platen roller 22*b* and with the platen roller 22*b* and the ink ribbon rewind shaft 22*a* set still, the tape feed shaft 24*a* is rotated. As a result, the tape T is fed in the opposite direction to the feeding direction. The control unit 11 determines the position of the tape T and controls the feeding of the tape T. The position of the tape T is determined based on the number of the position marks on the tape T counted by the mark counter 30. When the number of the position marks counted becomes equal to the number of the position marks counted in step S1, the tape-feed-shaft drive motor 24 is stopped (step S2).

While the processes in the steps S1 and S2 are being executed, the control unit 11 develops an image to be printed with the yellow ink Y into the print buffer in the RAM 14.

When the process in step S2 is finished, the control unit 11 drives the thermal-print-head drive motor 20 through the printer controller 16 and the head-drive-motor driver 19 to press the thermal print head 18 against the platen roller 22*b*. Consequently, the ink ribbon R and the tape T are pressed against each other.

Under this situation, the control unit 11 heats the thermal print head 18 through the printer controller 16 and the head driver 17 in accordance with image data which has been read from the print buffer in the RAM 14. At this time, the platen/ink-ribbon-rewind-shaft drive motor 22 is driven so that the ink ribbon R and the tape T are fed in the feeding direction Q. As a result, the image data for yellow which has been developed in the print buffer is transferred on the tape T. When the tape T is fed, the mark counter 30 counts the number of the position marks on the tape T detected by the recording sheet sensor 29. This number is stored in the RAM 14 as feeding distance information of the tape T (step S3).

When printing with the yellow ink Y (first color) is completed in this manner, the ink ribbon R is fed in the feeding direction Q until the leading position of the magenta ink M comes to the position corresponding to the transfer position of the thermal print head 18.

The ink ribbon R is fed toward the ink ribbon rewind shaft 22*a* as the ink ribbon rewind shaft 22*a* rotates. The control unit 11 determines the position of the ink ribbon R based on the boundary mark m2 detected by the ink ribbon sensor 31. In this manner, the control unit 11 controls the feeding of the ink ribbon R. At this time, the platen roller 22*b* and the ink ribbon rewind shaft 22*a* rotate with the thermal print head 18 pressed against the platen roller 22*b*. Accordingly, the tape T is fed in the feeding direction by the same distance as the ink ribbon R. At this time, the mark counter 30 is counting the number of the position marks detected by the recording sheet sensor 29. The counted number of the position marks is added to the number of position marks counted in step S3 and the accumulated number is temporarily stored in the associated register in the RAM 14 (step S4).

Through the process in step S4, the leading edge of the tape T is located outward from the position of the cutter 26*a* by the positioning distance of the target ink of the ink ribbon R. Therefore, the leading edge of the tape T is fed to the initial position or the position of the cutter 26*a* to position the tape T.

With the thermal print head 18 separated from the platen roller 22*b* and with the platen roller 22*b* and the ink ribbon rewind shaft 22*a* set still, the tape feed shaft 24*a* is rotated. As a result, the tape T is fed in the opposite direction to the feeding-direction. The control unit 11 determines the position of the tape T and controls the feeding of the tape T. The position of the tape T is determined based on the number of the position marks on the tape T counted by the mark counter 30. When the number of the position marks counted becomes equal to the number of the position marks accumulated in steps S3 and S4, the tape-feed-shaft drive motor 24 is stopped (step S5).

While the processes in the steps S4 and S5 are being executed, the control unit 11 develops an image to be printed with the magenta ink M into the print buffer in the RAM 14.

When the process in step S5 is completed, the control unit 11 drives the thermal-print-head drive motor 20 through the printer controller 16 and the head-drive-motor driver 19 to press the thermal print head 18 against the platen roller 22*b*. Consequently, the ink ribbon R and the tape T are pressed against each other.

Under this situation, the control unit 11 heats the thermal print head 18 through the printer controller 16 and the head driver 17 in accordance with image data which has been read from the print buffer in the RAM 14. At this time, the platen/ink-ribbon-rewind-shaft drive motor 22 is driven so that the ink ribbon R and the tape T are fed in the feeding direction Q. As a result, the image data for magenta which has been developed in the print buffer is transferred on the tape T. When the tape T is fed, the mark counter 30 counts the number of the position marks on the tape T detected by the recording sheet sensor 29. This number is stored in the RAM 14 as feeding distance information of the tape T (step S6).

When printing with the yellow ink Y and magenta ink M is completed in this manner, the ink ribbon R is fed in the feeding direction Q until the leading position of the cyan ink C comes to the position corresponding to the transfer position of the thermal print head 18.

The ink ribbon R is fed toward the ink ribbon rewind shaft 22*a* as the ink ribbon rewind shaft 22*a* rotates. The control unit 11 determines the position of the ink ribbon R based on the boundary mark m3 detected by the ink ribbon sensor 31. In this manner, the control unit 11 controls the feeding of the ink ribbon R. At this time, the platen roller 22*b* and the ink ribbon rewind shaft 22*a* rotate with the thermal print head 18 pressed against the platen roller 22*b*. Accordingly, the tape T is fed in the feeding direction by the same distance as the ink ribbon R. At this time, the mark counter 30 is counting the number of the position marks detected by the recording sheet sensor 29. The counted number of the position marks is added to the number of position marks counted in step S6 and the accumulated number is temporarily stored in the associated register in the RAM 14 (step S7).

Through the process in step S7, the leading edge of the tape T is located outward from the position of the cutter 26*a* by the positioning distance of the target ink of the ink ribbon R. Therefore, the leading edge of the tape T is fed to the initial position or the position of the cutter 26*a* to position the tape T.

With the thermal print head 18 separated from the platen roller 22*b* and with the platen roller 22*b* and the ink ribbon rewind shaft 22*a* set still, the tape feed shaft 24*a* is rotated. As a result, the tape T is fed in the opposite direction to the feeding direction. The control unit 11 determines the position of the tape T and controls the feeding of the tape T. The position of the tape T is determined based on the number of the position marks on the tape T counted by the mark counter 30. When the number of the position marks counted becomes equal to the number of the position marks accumulated in steps S6 and S7, the tape-feed-shaft drive motor 24 is stopped (step S8).

While the processes in the steps S7 and S8 are being executed, the control unit 11 develops an image to be printed with the cyan ink C into the print buffer in the RAM 14.

When the process in step S8 is completed, the control unit 11 drives the thermal-print-head drive motor 20 through the printer controller 16 and the head-drive-motor driver 19 to press the thermal print head 18 against the platen roller 22*b*. Consequently, the ink ribbon R and the tape T are pressed against each other.

Under this situation, the control unit 11 heats the thermal print head 18 through the printer controller 16 and the head driver 17 in accordance with image data which has been read from the print buffer in the RAM 14. At this time, the platen/ink-ribbon-rewind-shaft drive motor 22 is driven so that the ink ribbon R and the tape T are fed in the feeding direction Q. As a result, the image data for cyan which has been developed in the print buffer is transferred on the tape T. When the tape T is fed, the mark counter 30 counts the number of the position marks on the tape T detected by the recording sheet sensor 29. This number is stored in the RAM 14 as feeding distance information of the tape T (step S9).

When printing with the yellow ink Y, magenta ink M and cyan ink C is completed in this manner, the ink ribbon R is fed in the feeding direction Q until the leading position of the overprinting ink OP comes to the position corresponding to the transfer position of the thermal print head 18.

The ink ribbon R is fed toward the ink ribbon rewind shaft 22*a* as the ink ribbon rewind shaft 22*a* rotates. The control unit 11 determines the position of the ink ribbon R based on the boundary mark m4 detected by the ink ribbon sensor 31. In this manner, the control unit 11 controls the feeding of the ink ribbon R. At this time, the platen roller 22*b* and the ink ribbon rewind shaft 22*a* rotate with the thermal print head 18 pressed against the platen roller 22*b*. Accordingly, the tape T is fed in the feeding direction by the same distance as the ink ribbon R. At this time, the mark counter 30 is counting the number of the position marks detected by the recording sheet sensor 29. The counted number of the position marks is added to the number of position marks counted in step S9 and the accumulated number is temporarily stored in the associated register in the RAM 14 (step S10).

Through the process in step S10, the leading edge of the tape T is located outward from the position of the cutter 26*a* by the positioning distance of the target ink of the ink ribbon R. Therefore, the leading edge of the tape T is fed to the initial position or the position of the cutter 26*a* to position the tape T.

With the thermal print head 18 separated from the platen roller 22*b* and with the platen roller 22*b* and the ink ribbon rewind shaft 22*a* set still, the tape feed shaft 24*a* is rotated. As a result, the tape T is fed in the opposite direction to the feeding direction. The control unit 11 determines the position of the tape T and controls the feeding of the tape T. The position of the tape T is determined based on the number of the position marks on the tape T counted by the mark counter 30. When the number of the position marks counted becomes equal to the number of the position marks accumulated in steps S9 and S10, the tape-feed-shaft drive motor 24 is stopped (step S11).

When the process in step S11 is completed, the control unit 11 drives the thermal-print-head drive motor 20 through the printer controller 16 and the head-drive-motor driver 19 to press the thermal print head 18 against the platen roller 22*b*. Consequently, the ink ribbon R and the tape T are pressed against each other.

Under this situation, the control unit 11 heats the thermal print head 18 through the printer controller 16 and the head driver 17. At this time, the platen/ink-ribbon-rewind-shaft drive motor 22 is driven so that the ink ribbon R and the tape T are fed in the feeding direction Q. As a result, the overprinting ink OP is transferred over the yellow, magenta and cyan ink Y, M and C on the tape T.

When the tape T is fed, the mark counter 30 counts the number of the position marks on the tape T detected by the recording sheet sensor 29 (step S12).

Every time the transfer of the overprinting ink OP for one line is completed, the control unit 11 determines if the cut position of the leading edge portion of the tape T is at the position of the cutter 26*a*. This determination can be made by checking if the number of the position marks fittable in the distance L between the transfer position of the thermal print head 18 and the position of the cutter 26*a*, which is stored in the RAM 14, minus the number of the position marks fittable in the leading margin stored in the RAM 14 and the number of the position marks counted in step S12 becomes 0 (step S13).

When the cut position of the leading edge portion of the tape T is not at the position of the cutter 26*a* in step S13, the flow returns to step S12 to execute printing of the next line.

When it is determined in step S13 that the cut position of the leading edge portion of the tape T is at the position of the cutter 26*a*, the control unit 11 stops heating the thermal print head 18 through the printer controller 16 and the head driver 17. The control unit 11 also stops driving the platen/ink-ribbon-rewind-shaft drive motor 22 through the printer controller 16 and the rewind-shaft-drive-motor driver 21. Consequently, the transfer of the overprinting ink OP on the tape T and the feeding of the ink ribbon R and the tape T are stopped (step S14).

Next, the control unit 11 drive the tape-cutter drive motor 26 to actuate the cutter 26*a* through the printer controller 16 and the cutter-drive-motor driver 25. As a result, the unnecessary leading portion of the tape T is cut away (step S15).

When the unnecessary leading portion of the tape T is cut away in step S15, the control unit 11 heats the thermal print head 18 through the printer controller 16 and the head driver 17 to restart printing with the overprinting ink OP. The control unit 11 also drives the platen/ink-ribbon-rewind-shaft drive motor 22 through the printer controller 16 and the rewind-shaft-motor driver 21 to start feeding the color ink ribbon R and the tape T again.

When the tape T is fed, the mark counter 30 counts the number of the position marks on the tape T detected by the recording sheet sensor 29 (step S16).

Every time printing with the overprinting ink OP for one line is completed, the control unit 11 determines if the printing with the overprinting ink OP is for the last line (step S17).

When it is determined in step S17 that the printing with the overprinting ink OP is not yet for the last line, the flow returns to step S16 to execute printing of the next line.

When it is determined in step S17 that the printing is for the last line, the control unit 11 stops heating the thermal print head 18 through the printer controller 16 and the head driver 17. As a result, the printing with the overprinting ink OP is terminated (step S18).

When the printing with the overprinting ink OP stops in step S18, the control unit 11 drives the platen/ink-ribbon-rewind-shaft drive motor 22 through the printer controller and the rewind-shaft-motor driver 21 to feed the tape T until the cut position of the trailing edge of the tape T comes to the position of the cutter 26*a*. This feeding distance can be discriminated as the mark counter 30 counts the value which is acquired by adding the number of the position marks fittable in the leading margin stored in the RAM 14 to the number of the position marks fittable in the distance L between the thermal print head 18 and the cutter 26*a*. When the cut position of the trailing edge of the tape T comes to the position of the cutter 26*a*, the control unit 11 stops driving the platen/ink-ribbon-rewind-shaft drive motor 22 through the yellow ink 16 and the rewind-shaft-motor driver 21. Then, the control unit 11 drives the tape-cutter drive motor 26 to actuate the cutter 26*a* through the printer controller 16 and the cutter-drive-motor driver 25. As a result, the printed portion of the tape T is cut away (step S19).

The process of the color tape printer will be described specifically.

Figure 6:
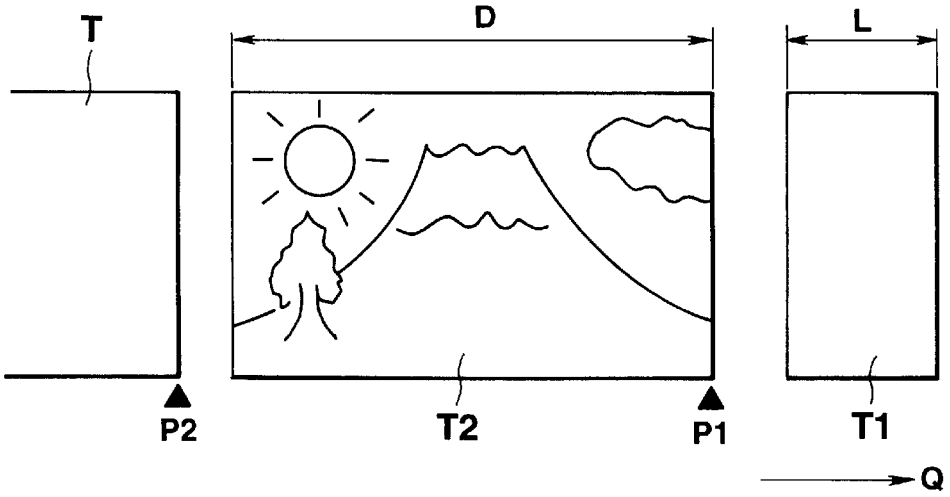
FIG. 6 is a diagram exemplifying the state of image data printed by the color tape printer according to this embodiment.

FIG. 6 is a diagram exemplifying the state of image data printed by this color tape printer.

This diagram shows an example of printing of an image, scanned by the image reader 27, on the tape T. In this example, the leading margin and trailing margin are not provided in the print area D. That is, the leading margin and trailing margin are both set to "0." The length of the unnecessary leading portion is equal to the distance L between the printing portion of the thermal print head 18 and the cutter 26*a*.

In the example, after printing with the yellow, magenta and cyan ink Y, M and C is done through the aforementioned steps S1 to S9, the overprinting ink OP is aligned with the tape T in steps S10 and S11.

Next, printing with the overprinting ink OP is carried out in steps S12 and S13. When the trailing edge P1 of the unnecessary leading portion of the tape T (the leading portion of the print range D) reaches the position of the cutter 26*a*, when the number of the position marks counted by the mark counter 30 becomes equal to the number of the position marks fittable in the distance L, printing and feeding are stopped in step S14. In the next step S15, the cutter 26*a* cuts away the unnecessary leading portion T1.

When the unnecessary leading portion T1 is cut away, printing with the overprinting ink OP in steps S16 and S17 starts again. When printing with the overprinting ink OP till the trailing edge P2 of the print range D is completed, printing on the tape T is stopped in step S18. Even after printing is terminated, the tape T is kept being fed. In step S19, the cutter 26*a* cuts away the printed area T2 of the tape T.

As described above, the color tape printer according to this embodiment cuts the tape at the time of printing with the overprinting ink OP so that printing with the yellow, magenta and cyan ink Y, M and C is not interrupted. Therefore, the thermal print head 18 does not discharge heat during printing with the yellow, magenta and cyan ink Y, M and C, thus preventing an uneven ink density from occurring.

As the tape T is cut during printing with overprinting ink OP, fast printing is possible.

According to this embodiment, color printing on the tape T is accomplished by the subtractive color mixture of the yellow ink Y, magenta ink M and cyan ink C which are arranged at the equal distances on the ink ribbon R. This invention is not however limited to this particular method. For instance, a 4-color ink ribbon having a black ink in addition to the yellow ink Y, magenta ink M and cyan ink C may also be used. It is also possible to use an ink ribbon which provides monochromatic printing using only a black ink. It is still possible to use an ink ribbon which retains ink of any single color.

Although the overprinting ink OP is made of a transparent thermally meltable resin in this embodiment, the material is not limited to this type. For example, an ink base material which contains no pigment or dye may be used for the overprinting ink OP.

In this embodiment, the ink ribbon R is provided with the area for the overprinting ink OP so that printing and feeding are stopped to cut the tape T at the time of performing printing with the overprinting ink OP. This invention can however be adapted for use with an ink ribbon which is not provided with the overprinting ink OP. For instance, an area which exposes the transparent film or the base material of the ink ribbon R may be provided instead of the area of the overprinting ink OP.

Further, an ink ribbon which does not have such an area and has only the yellow, magenta and cyan ink Y, M and C arranged at the equal distances may be used as well. In this case, after printing with the yellow, magenta and cyan ink Y, M and C is completed, the tape T is temporarily returned to the initial position. Then, the tape T is fed until the cut position of the leading edge is aligned with the position of the cutter 26*a*. Thereafter, the tape T is fed again so that the cut position of the trailing edge is aligned with the position of the cutter 26*a*.

In this embodiment, the leading positions of the yellow ink Y, magenta ink M, cyan ink C and overprinting ink OP are positioned by the detection of the boundary marks m1 to m4 provided on the color ink ribbon R by the ink ribbon sensor 32. The positioning of the leading positions of the individual ink is not however limited to this method. For example, position marks similar to those put on the tape T may be put at one edge of the ink ribbon R.

To detect the position of the tape T, the mark counter 30 counts the number of position marks put on the tape T in the above-described embodiment. However, the feeding distance of the tape T may be acquired by other methods. For instance, the tape T may be held by a pair of pinch rollers so that the position of the tape T is obtained by the rotation of the pinch rollers.

Although the count of the counter 30 is cleared when the feeding direction of the tape T is changed in this embodiment, the counter may be so designed as to count up the counter value when the tape T is fed in the feeding direction and to count down the value when the tape T is fed in the opposite direction to the feeding direction. In this case, it is possible to determine if the cut position of the tape T is at the position of the cutter 26*a* if the counter indicates a predetermined value.

As the ink ribbon R is fed, the thermal print head 18 is pressed against the platen roller 22*b* in this embodiment. Therefore, the tape T is fed in responsive to the feeding of the ink ribbon R. When the ink ribbon R is fed for the position of ink at the other time than the printing time, the thermal print head 18 may be set free from the platen roller 22*b*. That is, the tape T may not be fed in responsive to the feeding of the ink ribbon R.

In this embodiment, the cutter 26*a* is actuated by driving the tape-cutter drive motor 26. In other words, the tape cutter in this embodiment is an automatic cutter. This invention may however be adapted to a tape printer which is equipped with a manual cutter instead of an automatic cutter. In this case, printing and feeding are stopped when the tape cut position is aligned with the position of the manual cutter while printing with the overprinting ink OP is in progress. At this time, the display section 12 displays a message "cut the tape." When the user manipulates the operation lever of the manual cutter to cut the tape, printing with the overprinting ink OP and feeding of the tape T are restarted. This operation eliminates the need for the tape-cutter drive motor 26 and the cutter-drive-motor driver 25, which contributes to reducing the cost for the tape printer.

The tape printer according to this embodiment prints an image by a sublimination-oriented thermal transfer system. This invention is not however limited to this particular system. For example, this invention may be adapted to a melt type thermal transfer printer. The invention may be adapted for every type of printer which is likely to cause an uneven density when printing is stopped. For instance, this invention can be adapted to the case where when the head temperature changes, the amount of ink injected by an ink jet printer varies, resulting in a probable occurrence of an uneven print density. When this invention is adapted to an ink jet printer, there is not ink ribbon used. Therefore, an ink jet printer embodying this invention operates in the following way.

While the tape is being fed, ink is sprayed toward the tape from ink nozzles provided on the ink jet head to accomplish printing. The printing operation should not be stopped even when the cut position of the leading edge of the tape reaches the position of the cutter during printing. The tape is kept being fed until the cut position of the tape's leading edge comes to the position of the cutter again after the completion of the entire printing.

Although the foregoing description of this embodiment has been given with reference to the tape printer which prints an image on an elongated recording medium (tape), this invention may be adapted to any printer which makes a print on any type of recording medium as long as the printer needs to stop printing in order to cut the recording medium.

What is claimed is:

1. A printer comprising:

an ink ribbon retaining ink;

a print head for printing an image on a recording medium with said ink of said ink ribbon;

first feed means for feeding said ink ribbon;

second feed means for feeding said recording medium;

a cutter located away from said print head at a distance which is shorter than a size of said image to be printed on said recording medium, for cutting said recording medium; and control means for controlling operations of said print head, said first and second feed means, and said cutter;

said control means including:

print control means for causing said print head to transfer said ink onto said recording medium to print said image while causing said first and second feed means to simultaneously feed said ink ribbon and said recording medium, and cut control means for causing said second feed means to feed said recording medium until a cut position of a leading edge portion of said image printed on said recording medium comes to a position of said cutter, while stopping operation of said print head in response to termination of a print operation controlled by said print control means.

2. The printer according to claim 1, wherein said print head comprises a thermal transfer print head.

3. The printer according to claim 1, wherein said print head comprises a sublimation type thermal transfer print head.

4. The printer according to claim 1, wherein said print control means includes means for controlling said first and second feed means to continuously feed said ink ribbon and said recording medium until said print head finishes printing over a predetermined range of said recording medium.

5. The printer according to claim 2, wherein said print control means includes means for controlling said first and second feed means to continuously feed said ink ribbon and said recording medium until said print head finishes printing over a predetermined range of said recording medium.

6. The printer according to claim 3, wherein said print control means includes means for controlling said first and second feed means to continuously feed said ink ribbon and said recording medium until said print head finishes printing over a predetermined range of said recording medium.

7. The printer according to claim 1, wherein said second feed means operates responsive to an operation of said first feed means.

8. The printer according to claim 4, wherein said second feed means operates responsive to an operation of said first feed means.

9. The printer according to claim 1, wherein:

said recording medium has position marks; and said printer further comprises:

detection means for detecting said position marks; and position discrimination means for discriminating a position of said recording medium from said position marks detected by said detection means.

10. The printer according to claim 4, wherein:

said recording medium has position marks; and said printer further comprises:

detection means for detecting said position marks; and position discrimination means for discriminating a position of said recording medium from said position marks detected by said detection means.

11. The printer according to claim 1, wherein:

said position marks are provided at equal intervals along a feeding direction of said recording medium; and said position discrimination means comprises a counter for counting said position marks.

12. The printer according to claim 10, wherein:

said position marks are provided at equal intervals along a feeding direction of said recording medium; and said position discrimination means comprises a counter for counting said position marks.

13. The printer according to claim 1, wherein said cut control means includes:

discrimination means for discriminating if said cut portion of said leading edge portion of said image printed on said recording medium comes to said position of said cutter; and means for activating said cutter when said discrimination means discriminates that said cut position of said leading edge portion of said image printed on said recording medium has come to said position of said cutter.

14. The printer according to claim 4, wherein said cut control means includes:

discrimination means for discriminating if said cut portion of said leading edge portion of said image printed on said recording medium comes to said position of said cutter; and means for activating said cutter when said discrimination means discriminates that said cut position of said leading edge portion of said image printed on said recording medium has come to said position of said cutter.

15. The printer according to claim 1, wherein said cut control means includes:

discrimination means for discriminating if said cut portion of said leading edge portion of said image printed on said recording medium comes to said position of said cutter; and means for discriminating if said cutter is activated, whereby when said discrimination means discriminates that said cut portion of said leading edge portion of said image printed on said recording medium has come to said position of said cutter, an operation of said second feed means is stopped until an activation of said cutter is discriminated.

16. The printer according to claim 4, wherein said cut control means includes:

discrimination means for discriminating if said cut portion of said leading edge portion of said image printed on said recording medium comes to said position of said cutter; and means for discriminating if said cutter is activated, whereby when said discrimination means discriminates that said cut portion of said leading edge portion of said image printed on said recording medium has come to said position of said cutter, an operation of said second feed means is stopped until an activation of said cutter is discriminated.

17. A printer comprising:

an ink ribbon having regularly arranged ink areas retaining ink for printing an image and predetermined areas not retaining color ink;

a print head for transferring said ink of said ink area of the ink ribbon onto a recording medium;

first feed means for feeding said ink ribbon;

second feed means for feeding said recording medium;

a cutter for cutting said recording medium; and control means for controlling operations of said print head, said first and second feed means and said cutter;

said control means including:

print control means for causing said print head to print said ink on said recording medium with said ink areas placed over said recording medium while causing said first and second feed means to simultaneously feed said ink ribbon and said recording medium; and cut control means for causing said second feed means to simultaneously feed said ink ribbon and said recording medium with said predetermined areas placed over said recording medium until a cut position of a leading edge portion of said recording medium comes to a position of said cutter, in response to termination of an operation controlled by said print control means.

18. The printer according to claim 17, wherein said print head comprises a thermal transfer print head.

19. The printer according to claim 17, wherein said print head comprises a sublimation type thermal transfer print head.

20. The printer according to claim 17, wherein said print control means includes means for controlling said first and second feed means to continuously feed said ink ribbon and said recording medium until said print head finishes printing over a predetermined range of said recording medium with said ink.

21. The printer according to claim 18, wherein said print control means includes means for controlling said first and second feed means to continuously feed said ink ribbon and said recording medium until said print head finishes printing over a predetermined range of said recording medium with said ink.

22. The printer according to claim 19, wherein said print control means includes means for controlling said first and second feed means to continuously feed said ink ribbon and said recording medium until said print head finishes printing over a predetermined range of said recording medium with said ink.

23. The printer according to claim 17, wherein said second feed means operates responsive to an operation of said first feed means.

24. The printer according to claim 20, wherein said second feed means operates responsive to an operation of said first feed means.

25. The printer according to claim 17, wherein:

said recording medium has position marks; and said printer further comprises:

detection means for detecting said position marks; and position discrimination means for discriminating a position of said recording medium from said position marks detected by said detection means.

26. The printer according to claim 20, wherein:

said recording medium has position marks; and said printer further comprises:

detection means for detecting said position marks; and position discrimination means for discriminating a position of said recording medium from said position marks detected by said detection means.

27. The printer according to claim 25, wherein:

said position marks are provided at equal intervals along a feeding direction of said recording medium; and said position discrimination means comprises a counter for counting said position marks.

28. The printer according to claim 26, wherein:

said position marks are provided at equal intervals along a feeding direction of said recording medium; and said position discrimination means comprises a counter for counting said position marks.

29. The printer according to claim 17, wherein:

said predetermined areas comprise protection layer areas retaining a protective agent for forming a protection layer for protecting a print surface of said recording medium printed with said ink; and said print head transfers said protective agent onto said recording medium which is printed with said ink of said ink areas when said ink ribbon is fed with said protection layer areas placed over said recording medium.

30. The printer according to claim 20, wherein:

said predetermined areas comprise protection layer areas retaining a protective agent for forming a protection layer for protecting a print surface of said recording medium printed with said ink; and said print head transfers said protective agent onto said recording medium which is printed with said ink of said ink areas when said ink ribbon is fed with said protection layer areas placed over said recording medium.

31. The printer according to claim 17, wherein each of said ink areas retains a plurality of colors of ink arranged regularly.

32. The printer according to claim 20, wherein each of said ink areas retains a plurality of colors of ink arranged regularly.

33. The printer according to claim 17, wherein said cut control means includes:

discrimination means for discriminating if said cut position of said leading edge portion of said recording medium comes to said position of said cutter; and means for activating said cutter when said discrimination means discriminates that said cut position of said leading edge portion of said recording medium has come to said position of said cutter.

34. The printer according to claim 20, wherein said cut control means includes:

discrimination means for discriminating if said cut position of said leading edge portion of said recording medium comes to said position of said cutter; and means for activating said cutter when said discrimination means discriminates that said cut position of said leading edge portion of said recording medium has come to said position of said cutter.

35. The printer according to claim 17, wherein said cut control means includes:

discrimination means for discriminating if said cut position of said leading edge portion of said recording medium comes to said position of said cutter; and means for discriminating if said cutter is activated, whereby when said discrimination means discriminates that said cut position of said leading edge portion of said recording medium has come to said position of said cutter, an operation of said second feed means is stopped until an activation of said cutter is discriminated.

36. The printer according to claim 20, wherein said cut control means includes:

discrimination means for discriminating if said cut position of said leading edge portion of said recording medium comes to said position of said cutter; and means for discriminating if said cutter is activated, whereby when said discrimination means discriminates that said cut position of said leading edge portion of said recording medium has come to said position of said cutter, an operation of said second feed means is stopped until an activation of said cutter is discriminated.

37. A printing method for a printer, said printer comprising:

a print head for printing an image on a predetermined area of a recording medium; and a cutter, located away from said print head at a distance which is shorter than a size of said image to be printed on said recording medium, for cutting said recording medium while feeding said recording medium;

said method comprising the steps of:

printing an image on said recording medium without interrupting feeding of said recording medium even when a leading edge portion of said predetermined area of said recording medium reaches a position of said cutter until printing of said image on said predetermined area of said recording medium is completed;

feeding said recording medium until said leading edge portion of said recording medium comes to said position of said cutter after printing said image on said predetermined area of said recording medium is completed; and cutting said recording medium at said leading edge portion of said predetermined area with said cutter when feeding of said recording medium is stopped.

38. The printing method according to claim 37, wherein said step of printing comprises thermally transferring said image onto said recording medium.

39. A printer comprising:

an ink ribbon having regularly arranged ink areas retaining ink for printing an image and predetermined areas not retaining ink;

a print head for transferring said ink from said ink areas to a recording medium;

first feed means for feeding said ink ribbon;

second feed means for feeding said recording medium;

a cutter for cutting said recording medium; and control means for controlling operations of said print head, said first and second feed means and said cutter, said control means including:

print control means for causing said print head to print said ink on said recording medium with said ink areas placed over said recording medium while causing said first and second feed means to simultaneously feed said ink ribbon and said recording medium; and feed control means for causing said first and second feed means to simultaneously feed said ink ribbon and said recording medium with said predetermined areas placed over said recording medium until a cut position of a leading edge portion of said recording medium comes to a position of said cutter, in response to termination of an operation controlled by said print control means.

40. The printer according to claim 39, further comprising:

discrimination means for discriminating if said cut position of said leading edge portion of said recording medium comes to said position of said cutter; and means for activating said cutter when said discrimination means discriminates that said cut position of said recording medium has come to said position of said cutter.

* * * * *

UNITED STATES PATENT AND TRADEMARK OFFICE

CERTIFICATE OF CORRRECTION

PATENT NO. : 5,829,897
DATED : November 3, 1998
INVENTOR(S) : Murai

It is certified that error appears in the above-identified patent and that said Letters Patent is hereby corrected as shown below:

Title page, item [56], insert the following:

FOREIGN PATENT DOCUMENTS

| | | DOCUMENT NUMBER | | | | | | | PUBLICATION DATE | COUNTRY OR PATENT OFFICE | CLASS | SUBCLASS | TRANSLATION YES | TRANSLATION NO |
|---|---|---|---|---|---|---|---|---|---|---|---|---|---|---|
| | | 0 | 5 | 3 | 4 | 7 | 99 | A2 | 3/1993 | European | | | | |
| | | 0 | 5 | 8 | 0 | 4 | 38 | A2 | 1/1994 | European | | | | |
| | | 0 | 6 | 2 | 7 | 3 | 20 | A1 | 12/1994 | European | | | | |
| | | 0 | 6 | 4 | 1 | 6 | 63 | A2 | 3/1995 | European | | | | |
| | | 0 | 6 | 4 | 4 | 0 | 55 | A2 | 3/1995 | European | | | | |
| | | | | | | | | | | | | | | |

Signed and Sealed this

Sixth Day of April, 1999

*Attest:*

Q. TODD DICKINSON

*Attesting Officer*

*Acting Commissioner of Patents and Trademarks*